US005756204A

United States Patent [19]

Ellman

[11] Patent Number: 5,756,204

[45] Date of Patent: May 26, 1998

[54] WAX TRACTION PAD

[76] Inventor: Brett M. Ellman, 140 25th St., Del Mar, Calif. 92014

[21] Appl. No.: 413,827

[22] Filed: Mar. 30, 1995

[51] Int. Cl.[6] ..... B63B 35/79; C09J 7/02

[52] U.S. Cl. ..... 428/354; 441/74

[58] Field of Search ..... 428/343, 354; 441/74

[56] References Cited

U.S. PATENT DOCUMENTS

| | | | |
|---|---|---|---|
| 4,053,676 | 10/1977 | Kaminstein | 428/310 |
| 4,241,929 | 12/1980 | Curry | 280/12 H |
| 4,840,590 | 6/1989 | Kelley | 441/74 |
| 4,850,913 | 7/1989 | Szabad | 441/65 |
| 5,069,976 | 12/1991 | Vuachet | 428/474.4 |
| 5,308,271 | 5/1994 | Foulke | 441/74 |
| 5,314,940 | 5/1994 | Stone | 524/271 |
| 5,435,765 | 7/1995 | Fletcher | 441/74 |
| 5,454,743 | 10/1995 | Simonson | 441/74 |

*Primary Examiner*—Jenna Davis
*Attorney, Agent, or Firm*—John R Ross

[57] ABSTRACT

A wax traction pad. A support sheet is coated on the top side by a layer of traction wax. A adhesive layer coats the bottom side. In a preferred embodiment the support sheet is paper printed with a design, drawing or photograph of interest to surfers and laminated with clear plastic laminate and the bottom layer is a sticky wax. The pad is very easily applied to surfboards and is easily removed when removal is desired.

14 Claims, 2 Drawing Sheets

WAX TRACTION PAD

This invention relates to slip prevention traction materials and in particular to slip prevention traction materials for surfboards.

BACKGROUND OF THE INVENTION

Many traction materials are available for slip prevention. These include rubber pads for showers and bath tubs. Rubber pads are also available for use on surfboards; however, most surfers attempt to improve the traction on the top surface their surfboards by rubbing surfboard wax on the surface. This is time consuming and makes the board look quite messy. The wax tends to get dirty over time. The wax can be scraped off and new wax applied, but this is a time consuming difficult job. Rubber surfboard pads are often difficult to apply especially if the surfboard is not clean when application is attempted and the pads can be very difficult to remove. Sticky waxes are well know in the art supply industry. These waxes are used to temporarily post up art work. One well known brand of this type of wax is Slidex VF-72 distributed by Slidex Corp. with offices in New York, N.Y.

What is needed is a better traction pad which is decorative, easily applied and easily removed from otherwise slippery surfaces.

SUMMARY OF THE INVENTION

The present invention provides a wax traction pad. A support sheet is coated on the top side by a layer of traction wax. A adhesive layer coats the bottom side. In a preferred embodiment the support sheet is paper printed with a design, drawing or photograph of interest to surfers and laminated with clear plastic laminate and the bottom layer is a sticky wax. The pad is very easily applied to surfboards and is easily removed when removal is desired.

DETAILED DESCRIPTION OF PREFERRED EMBODIMENTS

The Pads

Preferred embodiments of the present embodiments may be described by reference to the drawings.

Figure 1A:
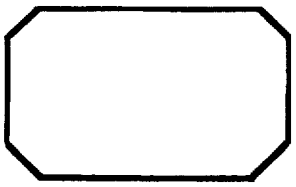
FIGS. 1 A, and B are patterns of preferred shapes of pads according to the present invention.
Figure 1B:
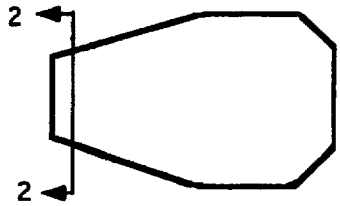
Figure 3:
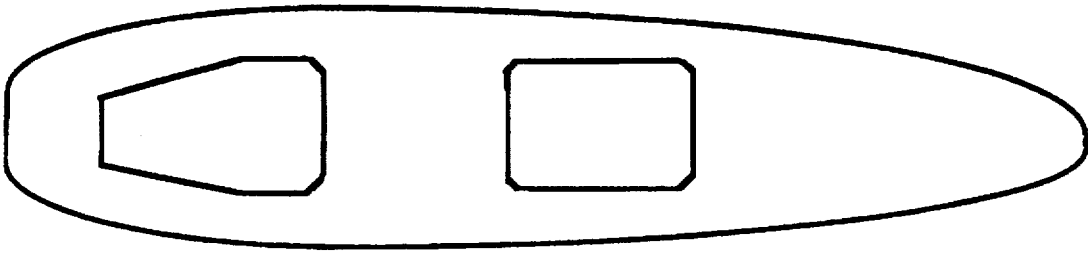
FIG. 3 shows the pads on a surf board.
Figure 2:
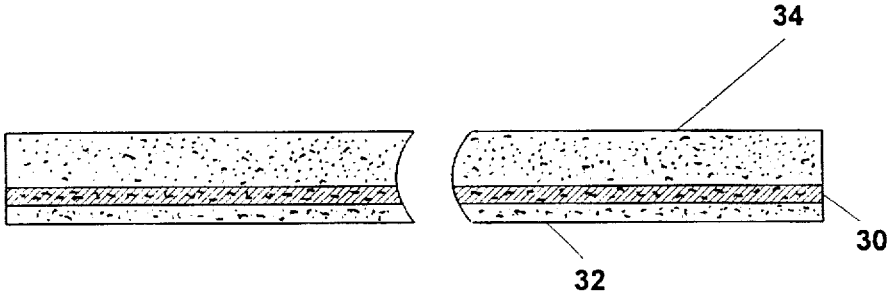
FIG. 2 is a section view of a preferred embodiment of the present invention.

FIG. 1A and FIG. 1B are drawings of patterns of two traction pads designed for use on a surfboard. FIG. 1 A is for the front of the board and FIG. 1B is for the back of the board. FIG. 3 is a top view of a surfboard showing where the pads would preferably be placed on the surfboard. FIG. 2 is a cross section view of the pad shown in FIG. 1A. The pad is comprised of three layers.

The middle layer 30 which I call the support sheet is a sheet of plastic laminated paper, about 0.003 inch thick. Preferably the paper has printed on it a design or other scene which is of interest to the customers of the pad. This could be the logo of the manufacturer of surf equipment or it could be a photograph of a beautiful girl in beach attire. The lamination is preferably clear plastic lamination coated one each side about 0.003 inch thick. This type of lamination service is available at many commercial copy shops.

The bottom layer 32 is comprised of an adhesive wax about 0.1 inch thick. A wide variety of adhesive waxes are available. In my prototype pads I have used with great success a wax comprised of a mixture of 2.5 pounds of Slidex VF-27 adhesive wax and 1 pound of petroleum jelly. Another possibility is a wax distributed by Cal Wax of Los Angeles, Calif. which is sold under the trade name of Sticky Wax. Other sticky waxes which could be used are the following formulations: (1) hydrogenated rosin—90 percent, flexo wax—5 percent,and partially polymerized petroleum—5 percent; (2) hydrogenated rosin—80 percent, flexo wax C—10 percent, and partially polymerized petroleum—10 percent; (3) rosin—16 parts, yellow beeswax—8 parts, vermilion 1 part; and (4) yellow beeswax—4 parts, rosin—1 part, gum dammar—1 part. A combination of 2.5 parts microcrystalline wax and 1 part petroleum jelly can also be used for the bottom layer.

The top layer 34 is about 0.03 inch thick. It is comprised of a traction wax. Again a wide variety of traction waxes are available, but I prefer to use a wax which I make up by blending one part white petroleum jelly with 8 parts microcrystalline wax. Greater proportions of petroleum jelly will decrease the stiffness of the wax. In my best prototype pads I used a microcrystalline wax distributed by Cal Wax under the trade name Victory White.

How to Make the Pads

Figure 4:
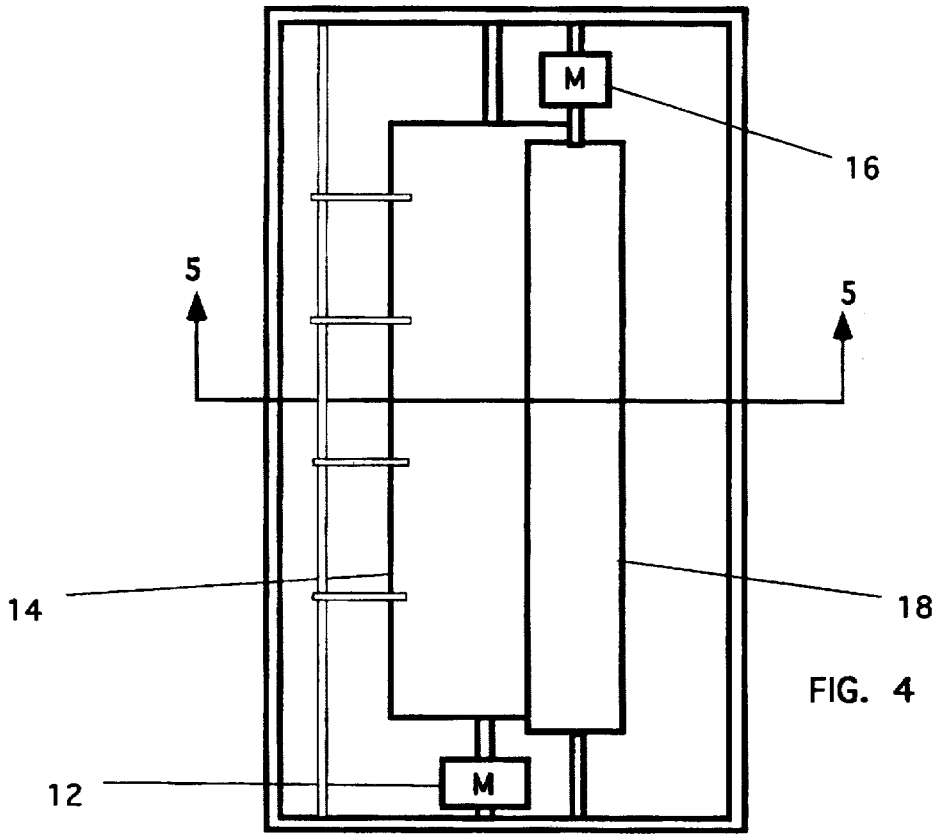
FIGS. 4 and 5 show a device for making preferred embodiments of the present invention.
Figure 5:
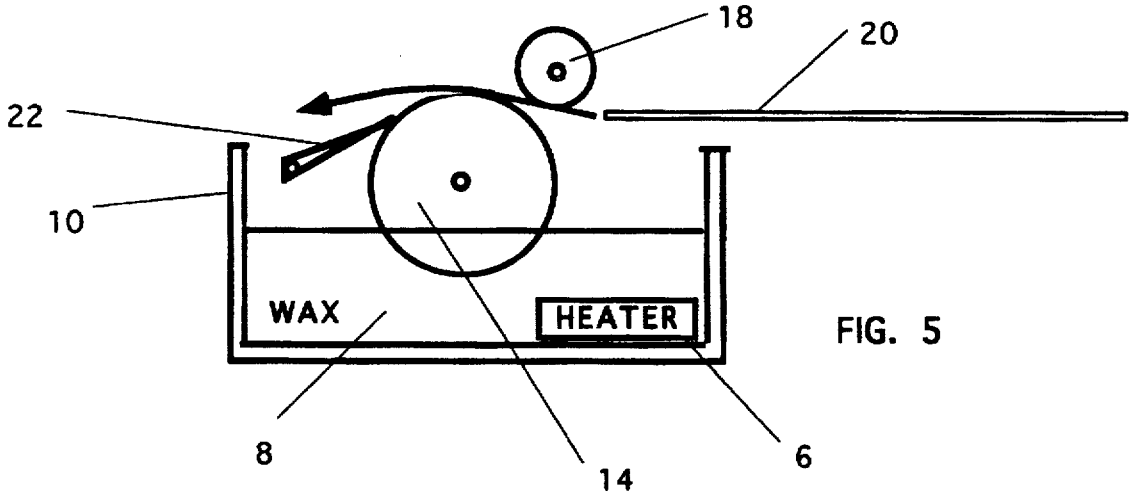

FIGS. 4 and 5 show my preferred method of making the pads. Heater 6 maintains a pool of wax 8 at a temperature of about 200 F in vat 10. First motor 12 rotates 4 inch diameter drum 14 at a speed of 52 RPM and second motor 16 rotates 1.5 inch diameter drum 18 at a speed of 120 RPM. Laminated paper 20 with a pattern as shown in FIGS. 1A or 1B is fed in between the two drums as indicated in FIGS. 4 and 5. Rotating drum 14 picks up hot wax from the pool of wax 8 and deposits it on the underside of paper 20. Fingers 22 keep the paper from tending to wrap on drum 14. The wax solidifies on the paper almost immediately. The same procedure is used for both sides of the paper, except the types of wax is different. Also, it normally takes 3 or 4 passes to provide the proper thickness for the top of the pad and 2 or 3 passes for the bottom of the pad.

Packaging the Pad

I place a release liner, comprised of a sheet of silicone impregnated paper against the sticky side of the pad for shipment and display and I package the pad in a suitable size plastic bag.

Installation on Surfboard

Installing the pad on surfboards is very simple. Merely remove the release liner, lay the pad on the board at the position indicated in FIG. 3 and burnish with a wax comb roughener. Use of the wax comb presses the pad to the board to assure the pads are firmly attached and also roughens up the surface of the traction wax. As the traction wax gets smooth from use the wax can be further roughened with the comb. The pad will typically last for several months for most surfers. When it needs to be replaced either because it is worn down or dirty, it can be pealed off very easily.

Other Uses

Although the pad was conceived and developed for surfboard use, it has a great many other potential uses. It can be used effectively anywhere bear feet are standing or walking on surfaces that are otherwise slippery. This includes boat surfaces and bathtubs and showers.

The foregoing description of the present invention has been presented for the purpose of illustration and is not intended to limit the invention to the precise form disclosed. It is understood that many modifications and changes may be effected by those skilled in the art. For example, the support sheet could be many materials such as various fibrous materials like any stiff paper, synthetic paper, sheet rubber and sheet plastic. In place of the adhesive wax we could use a rubber or acrylic based pressure sensitive adhesive. Many other waxes other than the ones listed could be used. Special attention should be given to the melting point of the wax. Often surfers leave their boards inside their automobiles in the sunshine with the windows rolled up. The temperature in the automobiles can rise to in excess of 140 degrees F. Many waxes melt at these temperatures. If such waxes are used the users of the pads should be warned of this risk of their pads melting. Instead of using two relatively small pads as shown in FIG. 3, we could use one larger pad. Accordingly, it is intended by the appended claims to cover all modifications and changes as fall within the true spirit and scope of the invention.

I claim:

1. A surfboard wax traction pad combination comprising:

a) a surfboard, b) a wax traction pad comprising.

1)a support sheet defining a top side and a bottom side, 2) a first layer of wax coating said top side, and 3) a second layer of temporary adhesive coating said bottom side wherein said temporary adhesive attaches said bottom side to said surfboard, wherein said second layer of temporary adhesive is a layer of sticky wax.

2. A pad combination as in claim 1 wherein said support sheet is a sheet of paper laminated on both sides with a clear plastic laminate.

3. A pad combination as in claim 1 wherein said first layer of wax is a layer of traction wax.

4. A pad combination as in claim 1 wherein said support sheet is decorated with a decoration.

5. A pad combination as in claim 4 wherein said decoration relates to a surfing interest.

6. A wax traction pad combination as in claim 1 wherein said first layer of wax is a layer of traction wax and said second layer of temporary adhesive coating is comprised of sticky wax.

7. A pad combination as in claim 6 wherein said support sheet is a sheet of paper.

8. A pad combination as in claim 6 wherein said support sheet is a sheet of cardboard.

9. A pad combination as in claim 6 wherein the thickness of said support sheet is about 0.01 inch, the thickness of said traction wax is about 0.03 inch and the thickness of said sticky wax is about 0.01 inch.

10. A pad combination as in claim 6 wherein said traction wax is comprised of a mixture of microcrystalline wax and petroleum jelly.

11. A pad combination as in claim 6 wherein said traction wax is comprised of beeswax.

12. A pad combination as in claim 10 wherein said mixture is about one part petroleum jelly and 8 parts microcrystalline wax.

13. A pad combination as in claim 6 wherein said sticky wax is a mixture of about 2.5 parts microcrystalline wax and 1 part petroleum jelly.

14. A traction padded surfboard comprising:

A) a surfboard defining a top surface,

B) at least one wax traction pad attached to said top surface comprising:

1) a support sheet defining a top side and a bottom side, 2) a first layer of traction wax coating said top side, and 3) a second layer of sticky wax coating said bottom side.

* * * * *